US006006385A

United States Patent [19]

Kershaw et al.

[11] Patent Number: 6,006,385

[45] Date of Patent: Dec. 28, 1999

[54] MULTI-TOOL

[75] Inventors: Peter G. Kershaw, Lake Oswego; Douglas B. Flagg, West Linn; Craig Green, Tualatin, all of Oreg.; Katsumi Hasegawa, Tokyo, Japan

[73] Assignee: Kai U.S.A. Ltd., Wilsonville, Oreg.

[21] Appl. No.: 08/789,589

[22] Filed: Jan. 24, 1997

Related U.S. Application Data

[60] Provisional application No. 60/029,411, Oct. 31, 1996.

[51] Int. Cl.[6] ..... B25B 7/22

[52] U.S. Cl. ..... 7/129; 7/128; 7/168

[58] Field of Search ..... 7/125, 126, 127, 7/128, 129, 132, 167, 168; 30/160, 161; 81/490, 177.4, 489, 177.1, 427.5

[56] References Cited

U.S. PATENT DOCUMENTS

| | | | |
|---|---|---|---|
| D. 137,408 | 3/1944 | Frisk . | |
| 237,138 | 2/1881 | Slayton | 7/168 |
| D. 365,266 | 12/1995 | Hasegawa . | |
| 542,601 | 7/1895 | Baker . | |
| 589,392 | 8/1897 | Kolar . | |
| 596,096 | 12/1897 | Watts . | |
| 614,537 | 11/1898 | Dahlquist . | |
| 649,334 | 5/1900 | Meloos . | |
| 662,005 | 11/1900 | Lewis . | |
| 790,432 | 5/1905 | Heilrath . | |
| 857,459 | 6/1907 | Hendrickson . | |
| 858,003 | 6/1907 | Klever . | |
| 888,795 | 5/1908 | Fields . | |
| 896,746 | 8/1908 | McCarty . | |
| 1,174,132 | 3/1916 | Dragun . | |
| 1,184,746 | 5/1916 | Hanson . | |
| 1,187,842 | 6/1916 | Kaas . | |
| 1,370,906 | 3/1921 | Newton . | |
| 1,467,661 | 9/1923 | Undy . | |
| 1,474,592 | 11/1923 | Jacoby . | |
| 1,511,340 | 10/1924 | Jackson . | |
| 1,524,694 | 2/1925 | Di Maio . | |
| 1,551,328 | 8/1925 | Perry . | |
| 1,561,833 | 11/1925 | Cruickshank . | |
| 1,561,993 | 11/1925 | Nielsen . | |
| 1,619,181 | 3/1927 | Beretz . | |
| 2,514,130 | 7/1950 | Jones . | |
| 2,561,682 | 7/1951 | Barnett . | |
| 2,575,652 | 11/1951 | Bovee . | |

(List continued on next page.)

OTHER PUBLICATIONS

Kutmaster Advertisement for the Multimaster.

*Primary Examiner*—David A. Scherbel
*Assistant Examiner*—Joni B. Danganan
*Attorney, Agent, or Firm*—Kolisch Hartwell Dickinson McCormack & Heuser

[57] ABSTRACT

A multi-tool with a handle formed to have a cross section that is S-shaped so that a foldable tool stored in the handle may be opened and closed independently of other selected operations for the multi-tool. The foldable tool is stored in a first pocket, facing away from an opposing handle, and an adjustment mechanism is stored in a second pocket, facing toward the opposing handle. A leaf spring is cut from an opposing wall of the first pocket, and biased so that the leaf spring moves to a blocking position at least partially within the first pocket when the foldable tool is in an open position. A post is mounted on the foldable tool and is exposed for engagement by a human hand to facilitate deployment of the foldable tool from its closed position to its open position. The S-shaped construction of the handle allows a flange to be incorporated as part of the handle without interfering with the foldability of the foldable tool stored in the first pocket of the handle. The flange coordinates with a shoulder formed on another foldable tool stored in the opposing handle to provide a positive-positional lock for the other foldable tool when the handles are placed in a pressed-together position, increasing the safety and utility of the multi-tool when using foldable tools like a saw or a screwdriver. A clasp augments the positive-positional lock by locking the handles in the pressed-together position, thereby locking the other foldable tool in the open position.

23 Claims, 4 Drawing Sheets

U.S. PATENT DOCUMENTS

| | | | |
|---|---|---|---|
| 2,641,149 | 6/1953 | Petersen . | |
| 2,747,446 | 5/1956 | Eder . | |
| 3,044,081 | 7/1962 | Robinson . | |
| 3,798,687 | 3/1974 | Stevens . | |
| 3,947,905 | 4/1976 | Neff . | |
| 4,238,862 | 12/1980 | Leatherman . | |
| 4,297,756 | 11/1981 | Lance | 7/127 |
| 4,347,665 | 9/1982 | Glesser . | |
| 4,502,220 | 3/1985 | Aoki . | |
| 4,512,051 | 4/1985 | Magan . | |
| 4,563,833 | 1/1986 | Aucoin . | |
| 4,744,272 | 5/1988 | Leatherman . | |
| 4,856,132 | 8/1989 | Burns et al. | 7/168 |
| 4,888,869 | 12/1989 | Leatherman . | |
| 4,896,424 | 1/1990 | Walker | 30/161 |
| 4,942,637 | 7/1990 | Yeang-Yai . | |
| 5,029,355 | 7/1991 | Thai . | |
| 5,062,173 | 11/1991 | Collins . | |
| 5,074,046 | 12/1991 | Kolesky . | |
| 5,142,721 | 9/1992 | Sessions et al. . | |
| 5,212,844 | 5/1993 | Sessions et al. . | |
| 5,267,366 | 12/1993 | Frazer . | |
| 5,497,522 | 3/1996 | Chen . | |
| 5,537,750 | 7/1996 | Seber et al. | 30/160 |
| 5,697,114 | 12/1997 | McInstosh et al. | 7/128 |

MULTI-TOOL

This application claims the benefit under 35 U.S.C. § 119 of U.S. Provisional Patent Application Ser. No. 60/029,411, entitled LOCKING PLIER MULTI-TOOL, filed on Oct. 31, 1996.

BACKGROUND AND SUMMARY OF THE INVENTION

The present invention relates generally to multi-tools, which typically are pliers-based hand tools having one or more tools stored in one or both of the handles of the pliers. Other pliers-like devices may be the basis for the present multi-tool, such as scissors or wire cutters. The common element among pliers, scissors and wire cutters is that each includes a pair of opposing jaws operated by a pair of opposing handles. When the handles of such a jaw/handle combination store one or more tools, the entire device is a multi-tool.

The tools may be stored in a pocket formed in the handle. Examples of tools found in multi-tool handles include knife blades, can openers, screwdrivers, files, scissors, and saw blades. These tools fold into and out of the handle of the multi-tool, similar to a knife blade folding into and out of a pocket knife, and thus may be referred to in this document as foldable tools. Multi-tools often include other tools that do not fold, such as a ruler stamped into an exposed surface of one or both handles of the multi-tool.

Examples of prior multi-tools are found in U.S. Pat. Nos. 1,561,993, 3,798,687, 4,238,862, 4,563,833, 4,744,722, 4,888,869, 4,942,637, 5,029,355, 5,142,721, 5,212,844, and 5,267,366, incorporated herein by reference. Two of these patents, U.S. Pat. Nos. 4,238,862 and 5,029,355, disclose attempts to provide a locking mechanism for pliers as part of a multi-tool. In both of these prior multi-tools, the locking mechanism must be stored in a non-operating position, requiring the user of the multi-tool to deploy the locking mechanism from its non-operating position to its operating position before the pliers can be locked about an object. The user then needs to return the locking mechanism to its non-operating position after use. Deploying and returning the locking mechanism unduly complicates use of the locking aspect of the pliers of these prior multi-tools.

U.S. Pat. No. 4,238,862 also discloses a multi-tool in which the foldable tools are lockable in an extended, open position. The tool is locked when a tab on a locking spring aligns with a matching slot in the tool. The locking spring is formed as part of the web that interconnects opposing walls of the handle. Unlocking the tool from its locked, open position requires that another of the foldable tools stored in the same handle be unfolded partially to release the locking spring from the slot in the locked tool. The difficulty of unlocking a locked tool in this prior device has been found to be a drawback of the device.

U.S. Pat. No. 5,142,721 discloses an alternative locking mechanism to prevent a tool from folding from its open position to its closed position, as shown in FIG. 8 of that patent. The handles of the disclosed multi-tool may be pressed toward each other to a pressed-together position, and locked in that position by retracting the jaws into the handles. The tool-receiving pocket in each of the handles faces toward the other handle, and is obstructed by the other handle when the handles are in the pressed-together position. This prevents a foldable tool already in its open position from being returned to its pocket until the handles are released from the pressed-together position. It thus offers a type of locking mechanism for the various foldable tools in a multi-tool.

This locking mechanism is simple in practice and often effective. For certain uses, however, this prior art locking mechanism does not provide a sufficiently positive lock for the tool being used because the tool is able to pivot somewhat within its open position before it contacts the tools of the opposing handle. This results in a significant amount of free play in the tool when the tool is in its open position. Many tools, such as screwdriver tool blades, are much easier to use when positively locked in an open position, with little, if any, free play.

In the present multi-tool, the free play just described is eliminated by a positive lock provided by an outwardly extending shoulder formed on the foldable tools, adjacent the end of the tool and adjacent the pin on which the tool pivots. The shoulder interacts with a flange formed on the opposing handle. The flange exerts a concentrated force against the shoulder of the foldable tool when the handles are in the pressed-together position, and limits the amount of free play when the tool is in this locked position. A clasp is connected to one of the handles, and pivotable into engagement with the other of the handles to lock the handles in the pressed-together position, if desired.

At least one of the handles of the present multi-tool may be formed to include two oppositely facing pockets in which tools may be stored. For example, one of the pockets in the preferred embodiment stores a foldable knife blade, and the other stores an adjustment mechanism used in locking the multi-tool's plier jaws about an object. When viewed along the handles, approximately perpendicular to the longitudinal axis of the handles, at least one of the handles may be formed so that its body has a cross section that is S-shaped. The other handle may be U-shaped or S-shaped, and preferably includes at least one pocket that faces toward the S-shaped handle so that the pressed-together locking position of the handles may be used to lock open foldable tools stored in the other handle.

Forming oppositely facing pockets in a single handle allows at least one foldable tool to be exposed regardless of the orientation of the tool-receiving handle relative to the opposing handle. Thus, the exposed tool may be opened and closed even if the plier jaws are clamped about an object. The exposed tool also may be a foldable tool, while the tool in the oppositely facing pocket may be a non-foldable tool. A further alternative made possible by the oppositely facing pockets of the present multi-tool is that the exposed tool may be opened and closed while another foldable tool is locked in an open position by the pressed-together locking position of the handles, just described.

In the prior art multi-tools, the combination of easily locked foldable tools and exposed foldable tools was not possible. In some prior multi-tools, there is no exposed foldable tool. In other prior multi-tools, the handles need to be placed in a non-operating position if a foldable tool is to be exposed. In yet other prior multi-tools, none of the pockets in the handles allows a pressed-together locking function for the foldable tools. The present multi-tool offers an effective solution for these prior art problems, a solution not previously available.

A furter improvement found in the preferred embodiment of the present multi-tool is a post mounted on at least one of the foldable tools. The post is exposed for engagement by a human hand to facilitate one-handed deployment of the knife blade from its closed position to its open position. This is particularly useful when the post is mounted on the exposed tool in one of the oppositely facing pockets just described.

The pocket in which the foldable knife blade is stored also preferably is formed to include a leaf spring that extends into the pocket, and that locks the knife blade in an open position by blocking at least a portion of the tool-receiving pocket. This leaf spring is exposed for engagement by a human hand so that the leaf spring may be pushed back out of the pocket to allow the knife blade to return to its closed position. All of the foldable tools of the present multi-tool therefore are provided with a lock to hold the tools firmly in an open position.

It is an object of the present invention to provide a multi-tool in which at least one foldable tool is usable despite the orientation of the handles of the multi-tool.

It is a further object of the invention to provide a multi-tool in which foldable tools may be locked in a positive-locked open position by locking the handles in a pressed-together position.

Yet another object of the invention is to provide a multi-tool in which a foldable tool is locked in its open position by a leaf spring that extends into a tool-receiving pocket.

Yet another object of the invention is to provide a multi-tool in which a foldable tool is easily deployable in one-handed use.

Additional objects and advantages of the present invention will be understood more readily after a consideration of the drawings and the Detailed Description of the Preferred Embodiment.

DETAILED DESCRIPTION OF THE PREFERRED EMBODIMENT

Figure 1:
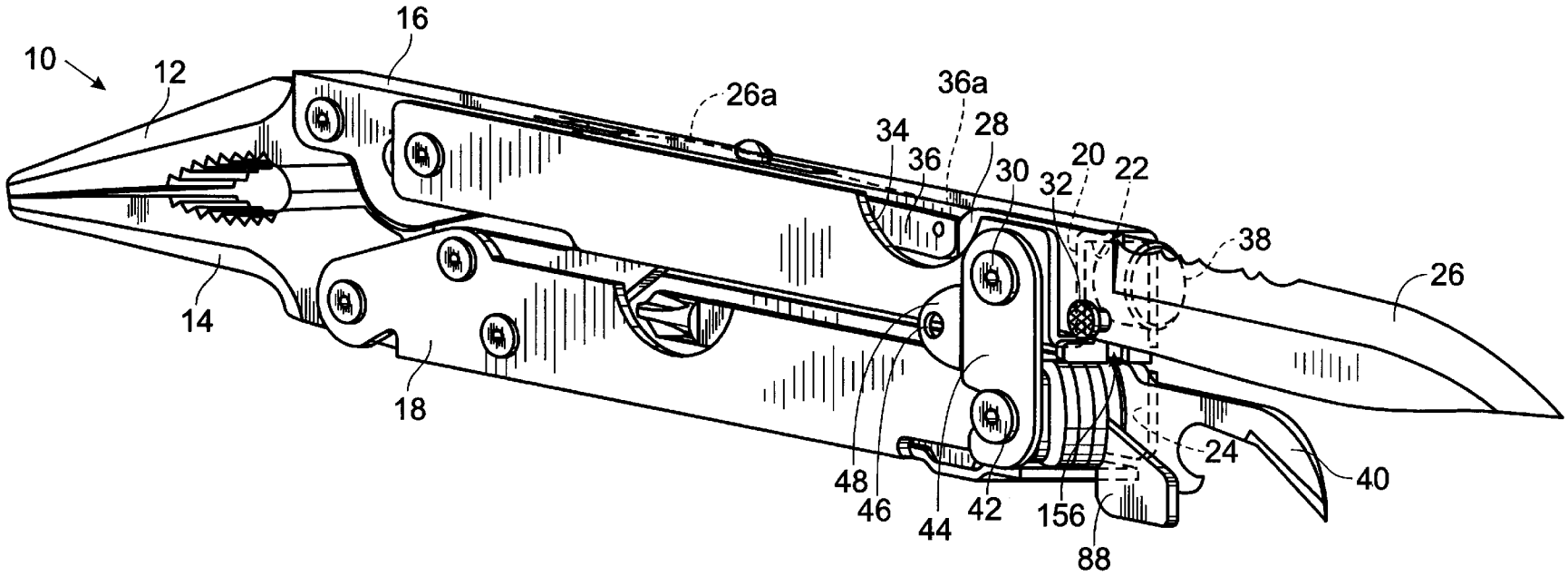
FIG. 1 is an isometric view of the preferred embodiment of the multi-tool of the present invention, taken from the upper right rear corner of the multi-tool, shown with its handles locked in a pressed-together position, with a can opener locked positively open by the handles, and with a knife locked open by a leaf spring that extends into the tool-receiving pocket for the knife.

Referring to FIG. 1, the multi-tool according to the present invention is shown generally at 10 and includes a pair of opposing jaws 12 and 14 connected to a pair of handles 16 and 18. Handles 16 and 18 are used to operate jaws 12 and 14, much like the handles on conventional locking pliers operate lockable plier jaws. Handles 16 and 18 therefore are operatively connected or attached to jaws 12 and 14.

Figure 7:
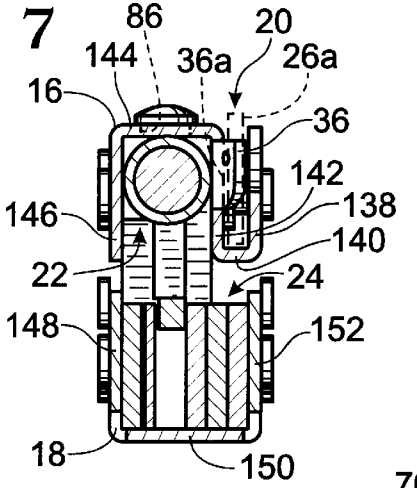
FIG. 7 is an end cross-sectional view of the multi-tool, taken generally along line 7—7 in FIG. 4.

Handle 16 is formed to include two oppositely facing elongate tool-receiving pockets 20 and 22, as shown in FIG. 1, and shown more clearly in cross section in FIG. 7. Pockets 20 and 22 cooperate to provide some of the advantages described above. One of pockets 20 and 22 therefore may be described as a first or primary pocket, and the other may be described as a second or auxiliary pocket. Handle 18 also is formed with a tool-receiving pocket 24, as indicated in FIG. 1, and shown more clearly in FIG. 7.

Returning to FIG. 1, a first tool 26 is stored in first pocket 20, preferably pivotally attached to first pocket 20 about an end 28 of first tool 26. A pin 30 preferably is connected to first pocket 20, and extends through end 28 of first tool 26. First tool 26 is shown as an elongate, serrated knife, but other foldable tools may be used in place of such a knife.

First tool 26 is storable in a closed position within pocket 20, as indicated in dashed lines at 26*a*. Tool 26 is pivotable from closed position 26*a* to an open position extending away from first pocket 20. In FIG. 1, one such open position is shown, in which tool 26 is shown at an angle of approximately 180-degrees relative to closed position 26*a* of tool 26.

Referring still to FIG. 1, it may seem that a post 32 preferably is mounted on tool 26 and exposed for engagement by a human hand when tool 26 is in closed position 26*a*. A cutout 34 may be formed in the S-shaped wall of pocket 20, and post 32 may be positioned on tool 26 so that post 32 aligns with cutout 34 when tool 26 is in its closed position 26*a*. Post 32 facilitates deployment of the tool from closed position 26*a* to its open position, and is typically engaged by the thumb of a human hand holding multi-tool 10.

A leaf spring 36 is cut from the wall that partially defines tool-receiving pocket 20, as will be understood more clearly after the discussion of FIGS. 7 and 8 below. Leaf spring 36 extends along a portion of tool-receiving pocket 20 and is biased so that leaf spring 36 moves to a blocking position at least partially within tool-receiving pocket 20 when tool 26 is in its open position. This prevents tool 26 from being returned to closed position 26*a* until leaf spring 36 is pushed away from its blocking position to a non-blocking position substantially out of tool-receiving pocket 20, as indicted in dashed lines at 36*a*. Cutout 34 provides easy access to leaf spring 36, so that it may be pushed to position 36*a* by a thumb or finger of a human hand.

Other tools are received storably in tool-receiving pockets 22 and 24. For example, a knob 38 that is part of an adjustment mechanism is shown extending from second pocket 22. Knob 38 is used in connection with the adjustment mechanism to adjust the lockability of multi-tool 10, as discussed in more detail below. A foldable tool 40, such as a can opener, is shown extending in an open position from third pocket 24. Tool 40 is attached pivotally to third pocket 24 by a pin 42, similar to the attachment of tool 26 to first pocket 20 by pin 30.

In FIG. 1, handles 16 and 18 are shown in an operating position in which jaws 12 and 14 are exposed for operative use and in which jaws 12 and 14 may be pressed toward a contacting position by handles 16 and 18. The jaws are shown touching each other, and thus are in a contacting position. Numerous other contacting positions are possible, as discussed in more detail below.

The discussion herein of an operating position for handles 16 and 18 has most meaning with reference to some prior art constructions of multi-tools in which the handles of the multi-tool are pivotable to a non-operating position. Such a multi-tool is shown in FIG. 1 of U.S. Pat. No. 4,238,862. Many aspects of the present invention are applicable to such a construction of a multi-tool, and it is intended that the claims appended hereto encompass such constructions.

Returning attention to FIG. 1 of the present document, handles 16 and 18 are shown connected to jaws 12 and 14 in such a way that handles 16 and 18 may be pressed toward each other in a pressed-together position. When handles 16 and 18 are in the pressed-together position, pocket 24 faces toward handle 16 and is obstructed by handle 16 so that pocket 24 effectively is closed. This prevents tool 40 from being folded from its open position extending away from pocket 24 to its closed position within pocket 24. Tool 40 may be locked in the open position by a clasp 44 that preferably pivots about pin 30 and engages pin 42. Clasp 44 provides a convenient location for a lanyard hole 46, formed in an angled tab 48.

Figure 3:
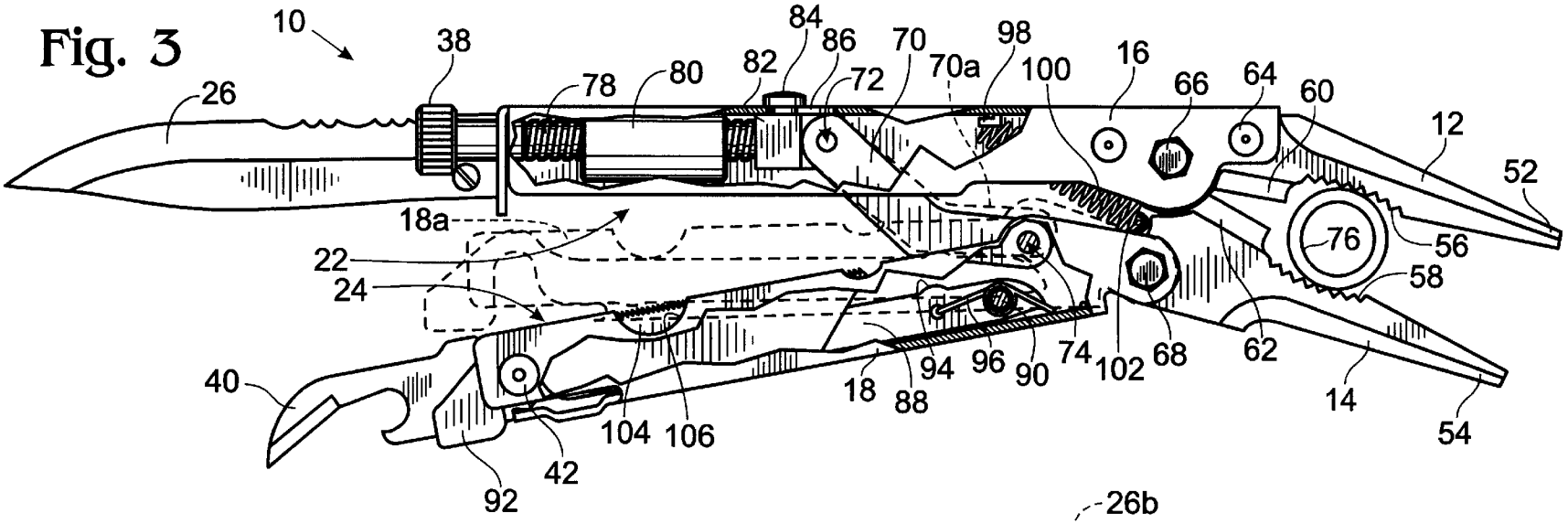
FIG. 3 is a left side elevation of the multi-tool shown in FIG. 2, with the jaws shown in a contacting, clamping position about a piece of pipe, with portions of the handles cut away to show the locking mechanism by which the jaws may be locked about an object, and with a locked position of the multi-tool shown in dashed lines.

In the pressed-together position of handles 16 and 18 shown in FIG. 1, first pocket 20 faces away from handle 18, and therefore tool 26 may pivot from its closed position 26*a* to its open position without a need to reposition handles 16 and 18 from the pressed-together position. This important advantage is also useful when handles 16 and 18 are in the many other operating positions possible with multi-tool 10, such as shown in FIG. 3, discussed in detail below, in which handles 16 and/or 18 may partially block one or more of tool-receiving pockets 22 and 24. Tool 26 preferably is a knife because it has been found that a knife is one of the most frequently needed tools of multi-tool 10. It is very useful to be able to open and close knife 26 even while handles 16 and 18 remain locked in a pressed-together position, or even while jaws 12 and 14 remain locked in a clamping position about an object. For example, jaws 12 and 14 may be holding a fishing lure, and knife 26 may be needed simultaneously to cut a fishing line.

Figure 2:
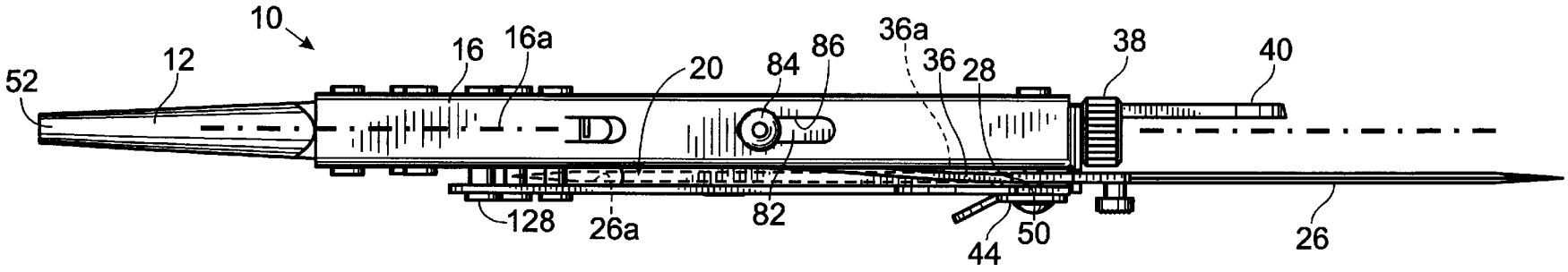
FIG. 2 is a top plan view of the multi-tool shown in FIG. 1, with the can opener and knife in their open positions.

Turning now to FIG. 2, a longitudinal axis of handle 16 is indicated at 16*a*. Tool 26 is shown again in its open position, with its closed position shown in dashed lines 26*a*, within pocket 20. The locking action provided by leaf spring 36 is shown more clearly with leaf spring 36 biased to its blocking position within pocket 20. The locking action results from a locking surface 50 formed at an end of leaf spring 36 that bears against end 28 of tool 26. Non-blocking position 36*a* is shown in dashed lines, with leaf spring 36 biased against tool 26 inclosed position 26*a*, but not blocking pocket 20.

Referring now to FIGS. 2 and 3 collectively, jaws 12 and 14 will be described briefly. FIG. 2 shows that jaw 12 preferably has a tapered nose portion 52. FIG. 3 shows a side view of nose portion 52, and shows a similarly tapered nose portion 54 of jaw 14. Tooth portions 56 and 58 and wire cutter portions 60 and 62 also preferably are formed in jaws 12 and 14, respectively.

As seen best in FIG. 3, jaw 12 is connected fixedly to handle 16 by a pair of pins 64 and 66. Pin 66 also serves as a pintle between jaws 12 and 14, allowing jaws 12 and 14 to open and close by pivotal action of jaw 14 around pin 66. Jaw 14 is connected pivotally to handle 18 by a pin 68.

Jaws 12 and 14 cooperate with handles 16 and 18 to create a locking action forjaws 12 and 14. A toggle link 70 is connected to handle 16 by a movable pivot 72, and connected to handle 18 by a fixed pivot 74. For a given position of movable pivot 72, jaws 12 and 14 will lock about an object such as pipe 76 shown in FIG. 3. A locked position of multi-tool 10 is achieved by pressing handles 16 and 18 toward each other until fixed pivot 74 moves just beyond a straight line defined by movable pivot 72 and pin 68.

FIG. 3 shows such a locked position of multi-tool 10, as indicated in dashed lines by handle 18*a* and toggle link 70*a*. In this locked position, handles 16 and 18 and toggle link 70 are in an inherently stable position for as long as a resisting force is applied to jaws 12 and 14, such as would be applied by pipe 76. Axial adjustment or positioning of movable pivot 72 within handle 16 changes the relative position of jaws 12 and 14 to one another, when viewed with respect to toggle link 70 and handles 16 and 18 in the locked position. This adjustment allows jaws 12 and 14 to clamp about objects of various sizes.

Still referring to FIG. 3, the preferred configuration of the adjustment mechanism alluded to above with respect to knob 38 is shown in detail. A threaded bolt 78 extends from knob 38 into second tool-receiving pocket 22 of handle 16. A threaded nut 80 is fixed to pocket 22, and bolt 78 is screwed into nut 80 so that rotating knob 38 causes bolt 78 to move into or out of pocket 22, as shown by the difference in position of knob 38 relative to handle 16, when FIG. 3 is compared to FIGS. 1 and 2.

Bolt 78 bears against a block 82 that is retained slidably in pocket 22 by a fastener 84. Fastener 84 extends through a slotted opening 86 formed in a wall defining at least a portion of pocket 22. Movable pivot 72 preferably is in the form of a toggle pin that is attached pivotally to block 82 and that extends through a hole formed in toggle link 70. Toggle link 70 is attached pivotally to block 82 about toggle pin 72.

When handles 16 and 18 and toggle link 70 are locked in the inherently stable position described above, it often is extremely difficult to pull handles 16 and 18 apart to unlock multi-tool 10. A release lever 88 therefore may be provided to pry handles 16 and 18 apart. Release lever 88 preferably is attached pivotally to pocket 24 of handle 18 by a release pin 90 that is connected to pocket 24 and that extends through release lever 88.

Release lever 88 pries handle 18 away from handle 16 by pushing on toggle link 70. An exposed end 92 of release lever 88 extends out of pocket 24 and is exposed for engagement by a human hand. Pressing end 92 away from pocket 24 and toward handle 16 forces toggle link 70 away from handle 18 and out of its locked position. This release action is facilitated by a protrusion 94 formed on release lever 88. Release lever 88 may be biased toward handle 18 by a coil spring 96 coiled about release pin 90.

Other aspects of the invention that are visible in FIG. 3 include a hook 98 formed in handle 16, a jaw spring 100, and a spring hole 102 formed in jaw 14. Spring 100 is stretched between hook 98 and spring hole 102, and biases jaws 12 and 14 to a normally open position. This facilitates one-handed use of the jaws feature of multi-tool 10.

An additional foldable tool 104 is shown in FIG. 3 as a hacksaw blade 104, exposed through a cutout 106 formed in handle 18. Tool 104 is attached pivotally to handle 18 by pin 42, and therefore is foldable and lockable similar to tool 40. While discussing both tools 40 and 104, it should be noted that the blades for both of these tools may be and in fact preferably are reversed from that shown in the drawings, so that the cutting edges of can opener 40 and of saw blade 104 face toward handle 16 when tools 40 and 104 are in their open positions.

Figure 4:
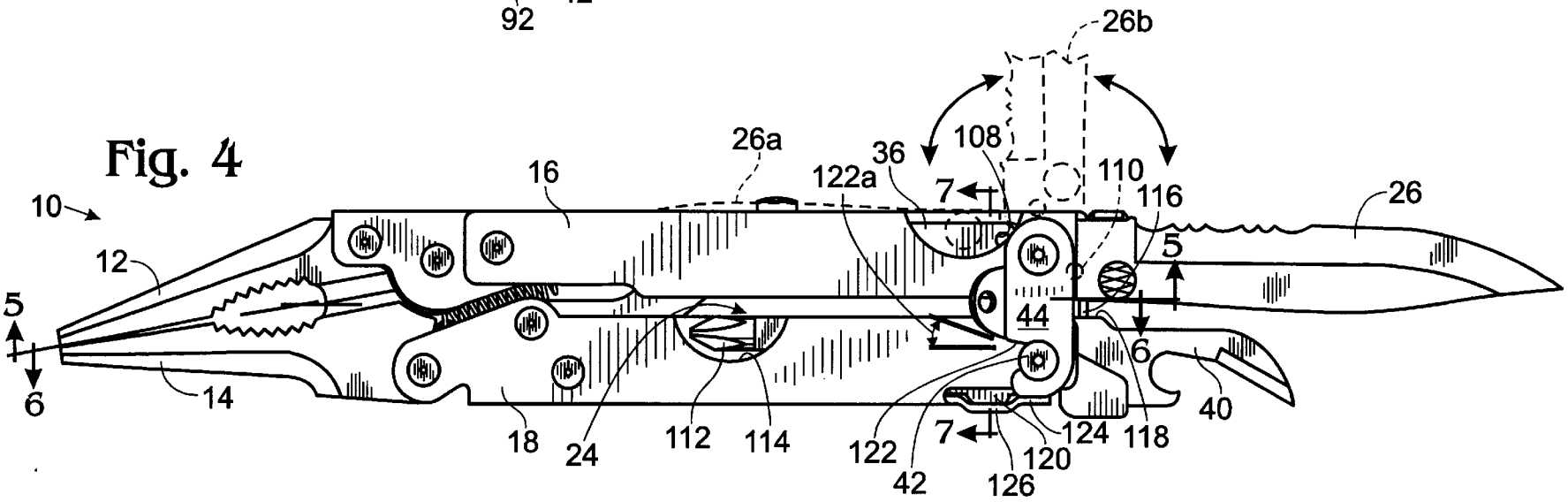
FIG. 4 is a right side elevation of the multi-tool shown in FIG. 2, with alternative folded positions of the knife shown in dashed lines.

Turning now to FIG. 4, tool 26 is shown pivoting to and from an open position, in solid lines, to a closed position 26*a*, in dashed lanes, and/or to an alternative open position 26*b*, also in dashed lines, extending away from handle 16 by an angle of approximately 90-degrees relative to closed position 26*a* and relative to open position represented by tool 26. The 90-degree orientation of open position 26*b* may be desirable for certain tools such as screwdrivers, in which handles 16 and 18 provide substantially more leverage than when a tool is used in the 180-degree orientation shown for tool 26. In the preferred embodiment, tool 26 is a knife, so it generally is opened to the 180-degree orientation prior to use, as shown in solid lines, and as discussed above with respect to FIG. 1.

Tool 26 may be snap-locked into closed position 26*a* so that tool 26 does not pivot open unintentionally. A small ball 108 preferably is press-fit into leaf spring 36, and a matching dimple 110 is formed on the left side of tool 26, on the far side of the knife blade that is shown in FIG. 4. When ball 108 is aligned with dimple 110, ball 108 and dimple 110 collectively form a snapping detent mechanism. Moderate force is required to open tool 26 from its snap-locked position 26*a*, and this moderate force generally is sufficient to keep tool 26 in its closed position 26*a* until needed.

An additional foldable tool 112 is shown in FIG. 4 as a Phillips screwdriver, exposed through a cutout 114 formed in handle 18. Tool 112 is attached pivotally to handle 18 by pin 42, and therefore is foldable and lockable similarly to tools 40 and 104 (tool 104 is not shown in FIG. 4).

Tools 40, 104 and 112 may be held in what is referred to herein as a positively locked open position. The positive-locked feature is shown in FIG. 4 with respect to tool 40. It is achieved through the formation of a flange 116 as part of handle 16, which cooperates with a shoulder 118 on tool 40. Shoulder 118 is formed adjacent an end of tool 40 and adjacent pin 42, and extends outwardly from tool 40. Shoulder 118 faces toward handle 16 when handles 16 and 18 are in the pressed-together position and tool 40 is in the open position, and faces away from handle 16 when tool 40 is in the closed position.

Referring still to FIG. 4, it is seen that flange 116 and shoulder 118 define a single line of contact between handle 16 and tool 40. When clasp 44 is latched to hold handles 16 and 18 in the pressed-together position, a positive-positional lock for tool 40 thereby is provided by flange 116 and shoulder 118. It has been found that the positive-positional lock provided by shoulder 118 facilitates use of tools such as screwdrivers, which otherwise might tend to fold somewhat from the 180-degree orientation shown for tool 40. Similar shoulders are formed on the other folding tools stored in pocket 24, and may contact flange 116. For example, a shoulder 120 is shown as part of tool 112, similar to shoulder 118 of tool 40.

Another feature of the positive-positional lock is formed as part of clasp 44. A sloped slot 122 in clasp 44, having a slope indicated at 122*a*, aligns with pin 42. Slope 112*a* increases the pressure exerted between handles 16 and 18, as clasp 44 is pivoted toward pin 42, thereby increasing the positive-positional lock of multi-tool 10.

Each of the foldable tools stored in pocket 24 also is biased to certain positions by a web spring 124, formed as part of handle 18. Web spring 124 is adjacent pin 42, to which foldable tools 40, 104 and 106 are attached pivotally. Web springs like spring 124 typically keep the foldable tools biased to their closed position, 180-degree orientation, or 90-degree orientation, regardless of whether the foldable tool is also locked in one of those positions. An important difference between web spring 124 and the web springs of the prior art is that a bulge 126 is formed in web spring 124 to extend outwardly from handle 18. Bulge 126 conforms to the shoulders of the folding tools, such as shoulders 118 and 120 of tools 40 and 112, when the foldable tools are in their closed positions.

Figure 5:
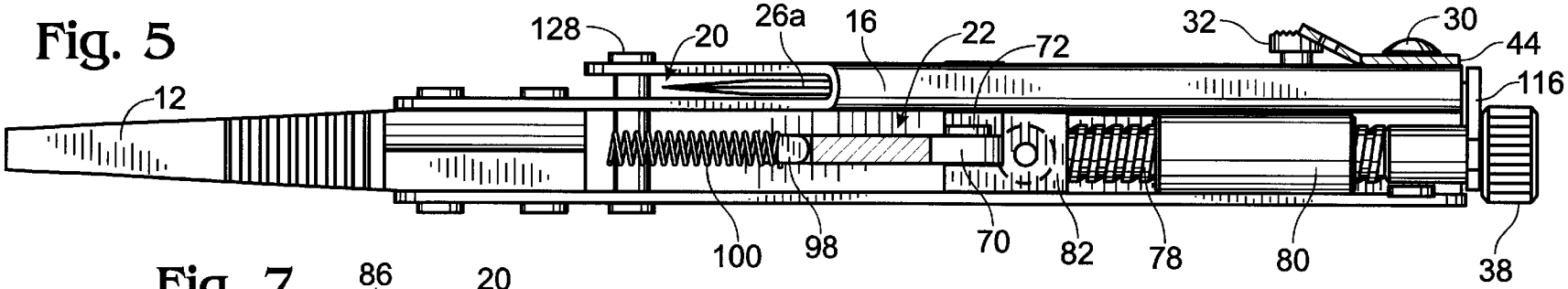
FIG. 5 is a bottom partially cross-sectional view of the multi-tool taken between the handles generally along line 5—5 in FIG. 4, showing the upper handle of the multi-tool.

In FIG. 5, the various elements of the adjustment mechanism are shown within pocket 22 of handle 16, as is a fragment of toggle link 70. A pin 128 is shown extending through both first pocket 20 and second pocket 22. The primary function of pin 128 is to provide structural support to first pocket 20.

Figure 6:
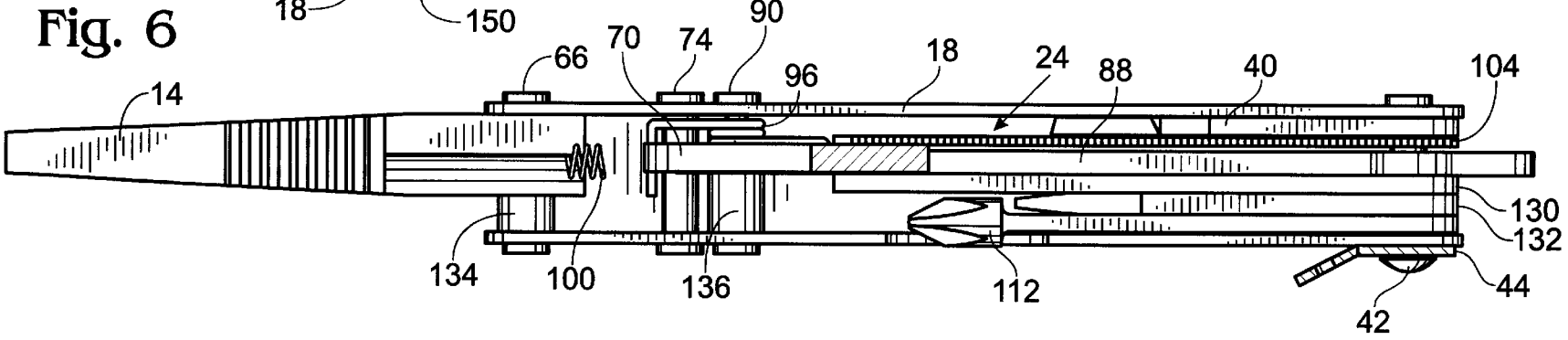
FIG. 6 is a top partially cross-sectional view of the multi-tool, taken between the handles generally along line 6—6 in FIG. 4, showing the lower handle of the multi-tool.

Turning now to FIG. 6, a view inside pocket 24 of handle 18 shows a fragment of toggle link 70 pivotally attached to fixed pivot 74. Release lever 88 is seen, as is coil spring 96, wrapped around release pin 90. The various foldable tools previously discussed are labeled, as are additional foldable tools 130 and 132, which may be similar to any of the foldable tools found in conventional multi-tools. Spacers 134 and 136 may be placed on pins 66 and 90 to keep selected components properly aligned within pocket 24. Spacer 134 keeps jaw 14 aligned with jaw 12, and spacer 136 keeps release lever 88 aligned with toggle link 70.

Referring now to FIG. 7, a cross-sectional view of handles 16 and 18 is shown. It will be seen that handle 16 includes a first opposing wall 138, an inside wall or web 140, and a second opposing wall 142, which collectively define tool-receiving pocket 20. Opposing walls 138 and 142 are interconnected by web 140.

Opposing wall 142 preferably is common to both tool-receiving pockets 20 and 22. An outside wall or web 144 and a third opposing wall 146, together with second opposing wall 142, collectively define tool-receiving pocket 22. Web 144 is the wall in which slotted opening 86 is formed, as shown in dotted lines in FIG. 7 and in solid lines in FIG. 2.

Opposing walls 138, 142, and 146, and webs 140 and 144 also collectively define a body for handle 16 that is formed to have a cross section that generally is S-shaped when the cross section is taken approximately perpendicular to longitudinal axis 16*a* of handle 16, as shown in FIG. 7. Wall 142 defines a central portion of the S-shaped cross section. It also will be seen in FIG. 7 that both pockets 20 and 22 generally are U-shaped tool-receiving pockets, when each pocket is viewed independently of the other.

FIG. 7 illustrates a simpler configuration for handle 18 than for opposing handle 16. Handle 18 includes a first opposing wall 148, a web 150, and a second opposing wall 152. Walls 148 and 152, and web 150, collectively define a generally U-shaped cross section for tool-receiving pocket 24.

Each of the bodies of handles 16 and 18 preferably is defined substantially by a contiguous sheet of material. The body of handle 16 is represented in FIG. 8 in flattened form as a sheet 154, with dashed lines showing where sheet 154 is bent to form handle 16. Sheet of material 154 may be made of steel, aluminum, or other metal.

Various portions of sheet 154 are labeled to indicate cutout 34, leaf spring 36, flange 116, opposing walls 138, 142, and 146, and webs 140 and 144. Most of the various holes formed in sheet 154 are labeled to correspond to the elements that are received by the holes. Holes 30*a* and 30*b* receive pin 30; holes 64*a* and 64*b* receive pin 64; holes 66*a* and 66*b* receive pin 66; and holes 128*a*, 128*b* and 128*c* receive pin 128. Hole 78*a* receives threaded bolt 78. Hole 108*a* receives ball 108, with ball 108 being press-fitted into hole 108*a* so that ball 108 is firmly held by and partly protrudes from hole 108*a*.

Figure 8:
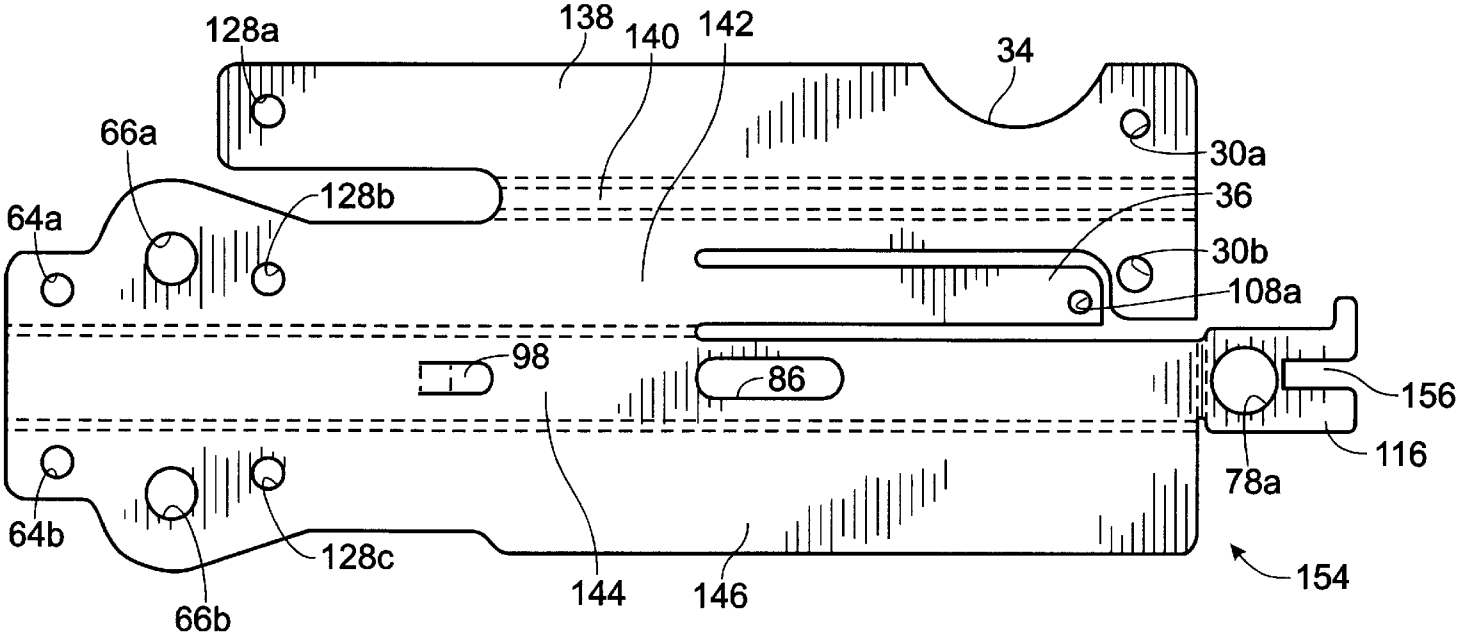
FIG. 8 is a plan view of a contiguous sheet of material cut to form one of the handles of the multi-tool shown in FIG. 1, prior to being bent into an S-shaped body for the upper handle of the multi-tool.

Slotted opening 86, discussed above with respect to FIG. 3, also is labeled in FIG. 8. So is a slot 156 that aligns with release lever 88 in the finished multi-tool 10, as understood best by reference to FIG. 1. Slot 156 provides clearance for release lever 88 so that pivoting of release lever 88 to unlock multi-tool 10 from its locked position is unimpaired.

Figure 9:
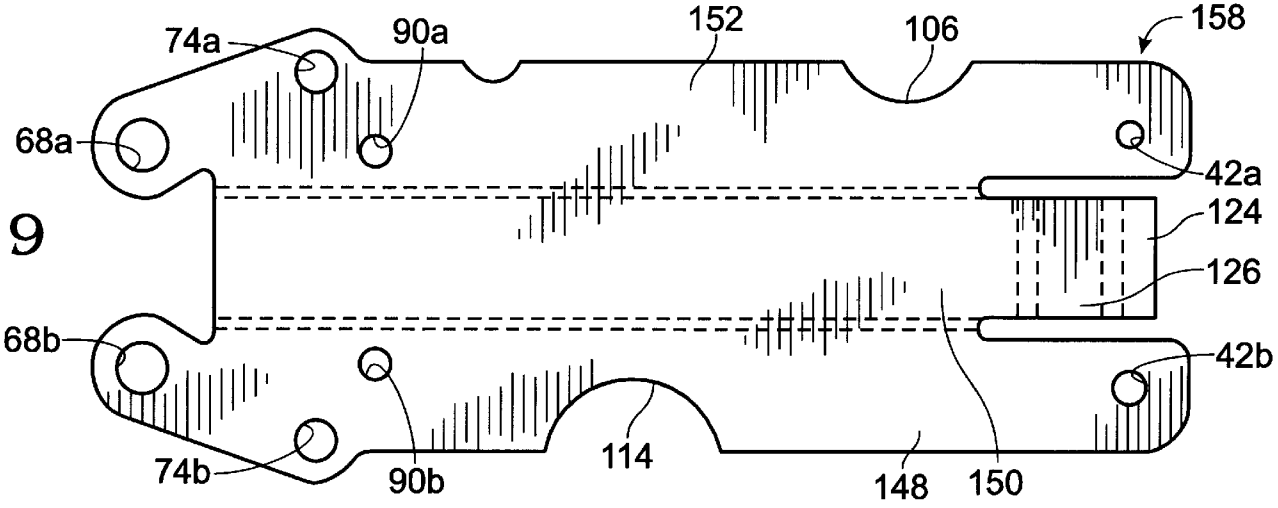
FIG. 9 is a plan view of a contiguous sheet of material cut to form the other of the handles of the multi-tool, prior to being bent into a U-shaped body for the lower handle of the multi-tool.

Turning finally to FIG. 9, a contiguous sheet of material 158 is shown in flattened form similarly to that shown for sheet 154 in FIG. 8. Sheet 158 is used to form handle 18, and the various portions of handle 18 have been labeled accordingly. Holes 42*a* and 42*b* receive pin 42; holes 68*a* and 68*b* receive pin 68; holes 74*a* and 74*b* receive fixed pivot 74; and holes 90*a* and 90*b* receive pin 90.

From the foregoing identification of the various elements of multi-tool 10, it will be seen that multi-tool 10 offers several important features and advantages not found in conventional multi-tools. For example, handle 16 is formed to have a cross section that is S-shaped so that foldable tool 26 may be opened and closed independently of other selected operations for multi-tool 10. More specifically, foldable tool 26 is stored in first pocket 20, facing away from opposing handle 18, and an adjustment mechanism is stored in second pocket 22, facing toward opposing handle 18.

Another advantage is provided by leaf spring 36, preferably cut from opposing wall 142 of pocket 20, and biased so that leaf spring 36 moves to a blocking position at least partially within pocket 20 when tool 26 is in an open position. Leaf spring 36 provides a simple and effective locking mechanism for tool 26. The S-shaped cross section of handle 16 is particularly well-suited to the incorporation of leaf spring 36 as part of pocket 20, because leaf spring 36 may be formed in an interior wall of handle 16, such as opposing wall 142, shielded from substantial exposure. This prevents leaf spring 36 from catching or snagging clothing or other items that might be in close contact with multi-tool 10.

Yet another advantage is provided by post 32, mounted on tool 26 and exposed for engagement by a human hand. Post 32 facilitates deployment of tool 26 from its closed position to its open position, and coordinates well with leaf spring 36. For example, both leaf spring 36 and post 32 are exposed for engagement through cutout 34, formed in handle 16. Furthermore, both leaf spring 36 and post 32 are operable with the thumb of a hand holding multi-tool 10, allowing easy one-handed operation of the deployment, locking and unlocking of tool 26.

The S-shaped cross section of handle 16 also is conducive to the "pressed-together" method of locking a foldable tool in an open position. In particular, the S-shaped construction of handle 16 allows flange 116 to be incorporated as part of handle 16 without interfering with the foldability of tool 26 stored in pocket 20 of handle 16. Flange 116 coordinates with shoulder 118 to provide a positive-positional lock, increasing the safety and utility of multi-tool 10 when using foldable tools like saw 104 and screwdriver 118. Clasp 42 augments this method of locking foldable tools in an open position by locking handles 16 and 18 in the pressed-together position, thereby locking tool 40 in the open position.

Various other benefits and advantages of the present invention will be recognized by those having skill in the art, after studying the above descriptions, appended claims, and attached drawings. Thus, while the present invention has been shown and described by reference to the preferred embodiment, it will be apparent to those skilled in the art that other changes in form and detail may be made therein without departing from the spirit and scope of the invention defined in the appended claims.

While the invention has been disclosed in its preferred form, the specific embodiments thereof as disclosed and illustrated herein are not to be considered in a limiting sense as numerous variations are possible. Applicants regard the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or through presentation of new claims in this or a related application. Such claims, whether they are broader, narrower or equal in scope to the original claims, are also regarded as included within the subject matter of applicants' invention.

We claim:

1. A handle for operative attachment to a pair of opposing jaws so that the handle may be used to force the jaws into contact with an object, the handle comprising a body, wherein:

the body defines a longitudinal axis of the handle;

the body is formed to include two oppositely facing elongate tool-receiving pockets that extend approximately parallel to the longitudinal axis of the handle;

the body is formed to have at least a partial cross section that is S-shaped when the cross section is taken approximately perpendicular to the longitudinal axis of the handle;

a central portion of the S-shaped cross section is defined by a wall that is common to both of the tool-receiving pockets; and a leaf spring is cut from the wall, extending along a portion of one of the tool-receiving pockets and biased so that the leaf spring moves to a blocking position at least partially within the one of the tool-receiving pockets.

2. The handle according to claim 1, wherein the body is defined substantially by a contiguous sheet of material.

3. The handle according to claim 1, furter comprising:

an elongate tool storable in a closed position within one of the tool-receiving pockets, the tool attached to the pocket by a pin that extends through an end of the tool so that the tool is pivotable from the closed position to an open position extending away from the pocket by an angle of at least approximately 90-degrees relative to the closed position of the tool;

wherein a portion of the tool is exposed for engagement by a human hand when the tool is in the closed position, the portion sized to facilitate one-handed deployment of the tool from the closed position to the open position.

4. A handle for operative attachment to a pair of opposing jaws so that the handle may be used to force the jaws into contact with an object, the handle comprising a body, wherein:

the body defines a longitudinal axis of the handle;

the body is formed to include two oppositely facing elongate tool-receiving pockets that extend approximately parallel to the longitudinal axis of the handle;

the body is formed to have at least a partial cross section that is S-shaped when the cross section is taken approximately perpendicular to the longitudinal axis of the handle;

one of the tool-receiving pockets is defined by opposing walls that are interconnected by a web; and wherein the handle furter comprises:

a tool storable in a closed position within the one of the tool receiving pockets, the tool attached to the one of the tool-receiving pockets by a pin so that the tool is pivotable from the closed position to an open position extending away from the one of the tool-receiving pockets by an angle of at least approximately 90-degrees relative to the closed position of the tool; and a leaf spring cut from one of the opposing walls, extending along a portion of the one of the tool-receiving pockets and biased so that the leaf spring moves to a blocking position at least partially within the one of the tool-receiving pockets when the tool is in the open position, the leaf spring having a locking surface for bearing against the tool when the leaf spring is in the blocking position, wherein the locking surface interferes with a portion of the tool, thereby preventing the tool from being returned to the closed position until the leaf spring is pushed away from the blocking position.

5. The handle according to claim 4, wherein the body is defined substantially by a contiguous sheet of material.

6. The handle according to claim 4, wherein one of the opposing walls defines a wall that is common to both of the tool-receiving pockets.

7. The handle according to claim 4, further comprising a post mounted on the tool and exposed for engagement by a human hand when the tool is in the closed position, wherein the post is sized to facilitate deployment of the tool from the closed position to the open position.

8. A locking multi-tool comprising:

a pair of opposing jaws;

a tool-receiving handle and an opposing handle, the handles operatively connected to the jaws to force the jaws into a clamping position about an object, the tool-receiving handle including a first pocket and a second pocket, and the opposing handle including a fixed pivot;

a first tool stored in the first pocket, the first tool pivotally attached to the first pocket by a pin that is connected to the first pocket and that extends through an end of the first tool;

an adjustment mechanism stored in the second pocket, the adjustment mechanism defining a movable pivot within the second pocket; and a toggle link pivotally interposed the movable pivot of the tool-receiving handle and the fixed pivot of the opposing handle;

wherein:

the toggle link, tool-receiving handle and opposing handle collectively define an open position for the multi-tool in which the jaws are free to open and close, the toggle link, tool-receiving handle and opposing handle collectively define a locked position for the multi-tool in which the jaws are biased toward a clamping position by the toggle link and handles, the toggle link and handles being in an inherently stable position for as long as a resisting force is applied to the jaws, thereby allowing the jaws to lock about an object;

changing the adjustment mechanism to move the movable pivot changes the relative position of the jaws to one another when the toggle link and handles are in the locked position, thereby allowing the jaws to clamp about objects of various sizes;

the first pocket faces away from the opposing handle when the toggle link and handles are in the locked position; and the second pocket faces toward the opposing handle when the toggle link and handles are in the locked position.

9. The multi-tool according to claim 8, wherein the first tool is a knife.

10. The multi-tool according to claim 9, wherein the first tool is storable in a closed position within the first pocket, and is pivotable from the closed position to an open position extending away from the pocket by an angle of approximately 90-degrees relative to the closed position of the tool, the multi-tool further comprising a post mounted on the first tool and exposed for engagement by a human hand when the tool is in the closed position, wherein the post is sized to facilitate deployment of the tool from the closed position to the open position.

11. The multi-tool according to claim 8, wherein:

the first pocket is at least partially defined by a pair of opposing walls; and a leaf spring is cut from one of the opposing walls, extending along a portion of the first pocket and biased so that the leaf spring moves to a blocking position at least partially within the first pocket.

12. The multi-tool according to claim 8, wherein the first tool is storable in a closed position within the first pocket, and is pivotable from the closed position to an open position extending away from the pocket by an angle of approximately 90-degrees relative to the closed position of the tool, the multi-tool further comprising a post mounted on the first tool and exposed for engagement by a human hand when the tool is in the closed position, wherein the post is sized to facilitate deployment of the tool from the closed position to the open position.

13. The multi-tool according to claim 8, wherein:

the opposing handle includes a third pocket that faces toward the tool-receiving handle when the toggle link and handles are in the locked position;

a third tool is stored in the third pocket;

the third tool is attached pivotally to the third pocket by a second pin that is connected to the third pocket and that extends through an end of the third tool;

the third tool is storable in a closed position within the third pocket, and is pivotable from the closed position to an open position extending away from the pocket by an angle of approximately 180-degrees relative to the closed position of the third tool;

the third tool may be held in the open position by pressing the tool-receiving handle toward the opposing handle and holding the handles together so that the third pocket is obstructed by the tool-receiving handle, thereby preventing the third tool from being folded from the open position to the closed position; and a clasp is connected to one of the handles, and is pivotable into engagement with the other of the handles so that the handles are locked in a pressed-together position, thereby locking the third tool in the open position.

14. The multi-tool according to claim 8, wherein the movable pivot is formed by a block retained slidably in the second pocket and by a toggle pin that is attached to the block and that extends through the toggle link so that the toggle link is attached pivotally to the block about the toggle pin.

15. The multi-tool according to claim 14, wherein:

a slotted opening is formed in a wall defining at least a portion of the second pocket; and a fastener extends through the slotted opening and is attached to the block so that the block is retained slidably in the second pocket.

16. A multi-tool comprising:

a pair of opposing jaws;

a pair of handles for operative attachment to the pair of opposing jaws to force the jaws into a contacting position about an object, at least one of the handles comprising:

a tool-receiving U-shaped pocket substantially defined by a contiguous sheet of material, the tool-receiving U-shaped pocket including a pair of opposing walls that are interconnected by a web;

a tool storable in a closed position within the tool-receiving U-shaped pocket, the tool attached to the tool-receiving U-shaped pocket by a pin so that the tool is pivotable from the closed position to an open position extending away from the tool-receiving U-shaped pocket by an angle of at least approximately 90-degrees relative to the closed position of the tool; and a leaf spring cut from one of the opposing walls and contiguous with the sheet of material, the leaf spring extending along a portion of the tool-receiving U-shaped pocket and biased so that the leaf spring moves to a blocking position at least partially within the tool-receiving U-shaped pocket when the tool is in the open position, the leaf spring having a locking surface for bearing against the tool when the leaf spring is in the blocking position, wherein the locking surface interferes with a portion of the tool, thereby preventing the tool from being returned to the closed position until the leaf spring is pushed away from the blocking position to a position substantially out of the tool-receiving U-shaped pocket.

17. The multi-tool according to claim 16, further comprising an auxiliary U-shaped pocket connected to the tool-receiving U-shaped pocket, the auxiliary U-shaped pocket including a pair of opposing walls that are interconnected by a web.

18. The multi-tool according to claim 17, wherein the auxiliary U-shaped pocket is defined substantially by the contiguous sheet of material.

19. The multi-tool according to claim 17, wherein a cross section of the handle through the tool-receiving U-shaped pocket and the auxiliary U-shaped pocket is substantially S-shaped.

20. The multi-tool according to claim 17, wherein the one of the opposing walls of the tool-receiving U-shaped pocket also is one of the opposing walls of the auxiliary U-shaped pocket.

21. The multi-tool according to claim 16, further comprising a post mounted on the tool and exposed for engagement by a human hand when the tool is in the closed position, wherein the post is sized to facilitate deployment of the tool from the closed position to the open position.

22. A multi-tool comprising:

a pair of handles operatively connected to opposing jaws so that the handles may be used to force the jaws into a contacting position about an object, at least one of the pair of handles formed to include a tool-receiving pocket that faces toward the other of the handles when the handles are in an operating position in which the jaws are exposed for operative use and in which the jaws may be pressed toward a contacting position by the handles, the tool-receiving pocket being defined at least partially by a pair of opposing walls;

a tool storable in a closed position within the tool-receiving pocket, between the opposing walls, the tool attached to the pocket by a pin so that the tool is pivotable from the closed position to an open position extending away from the pocket, wherein the tool may be held in the open position by pressing the pair of handles together so that the tool-receiving pocket is obstructed by the other of the pair of handles, thereby preventing the tool from being folded from the open position to the closed position; and a clasp connected to one of the handles, and pivotable into engagement with the other of the handles so that the handles are locked in a pressed-together position, thereby locking the tool in the open position;

wherein:

the tool is formed to include a shoulder adjacent the end of the tool and adjacent the pin;

the shoulder extends outwardly from the tool so that the shoulder faces toward the other of the handles when the handles are in the pressed-together position and the tool is in the open position, and so that the shoulder faces away from the other of the handles when the handles are in the pressed-together position and the tool is in the closed position; and the shoulder defines a single line of contact between the other of the handles and the tool when the handles are in the pressed-together position and the tool is in the open position, thereby providing a positive-positional lock for the tool.

23. The multi-tool according to claim 22, wherein:

the tool-receiving pocket is defined further by a web that extends between the opposing walls;

a web spring is formed as part of the web adjacent the pin to which the tool is attached pivotally; and a bulge is formed in the web spring to extend outwardly from the tool-receiving pocket and to conform to the shoulder in the tool when the tool is in the closed position.

* * * * *